US006695447B1

(12) United States Patent
Wexler

(10) Patent No.: US 6,695,447 B1
(45) Date of Patent: Feb. 24, 2004

(54) INK JET RECORDING ELEMENT

(75) Inventor: Allan Wexler, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/260,663

(22) Filed: Sep. 30, 2002

(51) Int. Cl.[7] ..... B41J 2/01
(52) U.S. Cl. ..... 347/105; 428/32.1
(58) Field of Search ..... 347/105, 101; 428/195, 32.1

(56) References Cited

U.S. PATENT DOCUMENTS 4,785,313 A 11/1988 Higuma et al.
4,832,984 A 5/1989 Hasegawa et al.
5,027,131 A * 6/1991 Hasegawa et al. ..... 347/105
6,028,028 A * 2/2000 Nitta ..... 428/32.18
6,299,303 B1 * 10/2001 Wexler ..... 347/105
6,623,817 B1 * 9/2003 Yang et al. ..... 428/32.12
2002/0089568 A1 7/2002 King et al.

FOREIGN PATENT DOCUMENTS

EP 0 959 905 A1 12/1999
EP 1 188 573 A2 3/2002

* cited by examiner

*Primary Examiner*—Stephen D. Meier
*Assistant Examiner*—Manish Shah
(74) *Attorney, Agent, or Firm*—Chris P Konkol; Harold E. Cole

(57) ABSTRACT

An ink jet recording element having a support having thereon in order: a) at least one porous, ink carrier liquid receptive layer; b) a fusible, porous dye-trapping layer of fusible polymeric particles, a binder, and a dye mordant; and c) a fusible, porous ink-transporting layer of fusible, polymeric particles and a film-forming, hydrophobic binder.

18 Claims, No Drawings

INK JET RECORDING ELEMENT

CROSS REFERENCE TO RELATED APPLICATION

Reference is made to commonly assigned, co-pending U.S. patent application Ser. No. 10/260,128, by Wexler, filed of even date herewith, entitled Ink Jet Printing Method.

FIELD OF THE INVENTION

The present invention relates to a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof at least one ink-receiving layer. The ink-receiving layer is typically either a porous layer that imbibes the ink via capillary action, or a polymer layer that swells to absorb the ink. Transparent swellable hydrophilic polymer layers do not scatter light and therefore afford optimal image density and gamut, but take an undesirably long time to dry. Porous ink-receiving layers are usually composed of inorganic or organic particles bonded together by a binder. During the ink jet printing process, ink droplets are rapidly absorbed into the coating through capillary action and the image is dry-to-touch right after it comes out of the printer. Therefore, porous coatings allow a fast "drying" of the ink and produce a smear-resistant image. However porous layers, by virtue of the large number of air particle interfaces, scatter light which results in lower densities of printed images.

Elements which comprise two distinct layers have been constructed which have an uppermost porous layer and an underlying swellable polymer layer. Such constructions suffer from poor image quality, as the rate of ink absorption in the upper porous layer via capillary action is orders of magnitude faster than absorption by ink diffusion into the swellable layer. This difference in absorption rates leads to unwanted lateral diffusion of ink at the interface between the layers, a phenomenon termed bleed in the art.

Ink jet prints, prepared by printing onto ink jet recording elements, are subject to environmental degradation. They are especially vulnerable to damage resulting from contact with water and atmospheric gases such as ozone. The damage resulting from the post imaging contact with water can take the form of water spots resulting from deglossing of the top coat, dye smearing due to unwanted dye diffusion, and even gross dissolution of the image recording layer. Ozone bleaches ink jet dyes resulting in loss of density. To overcome these deficiencies, ink jet prints are often laminated. However, lamination is expensive as it requires a separate roll of material.

Efforts have been made to avoid lamination and yet provide protected inkjet prints by providing an inkjet receiver having an uppermost fusible ink-transporting layer and an underlying ink-retaining layer.

U.S. Pat. No. 4,785,313 and U.S. Pat. No. 4,832,984 relate to an ink jet recording element comprising a support having thereon a porous fusible, ink-transporting layer and a swellable polymeric ink-retaining layer, wherein the ink-retaining layer is non-porous. However, there is a problem with this element in that it has poor image quality.

EP 858, 905A1 relates to an ink jet recording element having a porous fusible ink-transporting outermost layer formed by heat sintering thermoplastic particles, and an underlying porous layer to absorb and retain the ink applied to the outermost layer to form an image. The underlying porous ink-retaining layer is constituted mainly of refractory pigments. After imaging, the outermost layer is made non-porous. There are problems with this element in that the ink-retaining layer remains light scattering and therefore fused prints suffer from low density, and the sintered outermost,layer has poor abrasion resistance.

EP 1,188,573 A2 relates to a recording material comprising in order: a sheet-like paper substrate, at least one pigment layer coated thereon, and at least one sealing layer coated thereon. Also disclosed is an optional dye trapping layer present between the pigment layer and the sealing layer. There are several problems with this element in that the binder in the sealing layer is water-soluble which degrades the water resistance of sealed prints. While the sealing layer is porous, the dye trapping layer is not which leads to bleed and degraded image quality.

It is an object of this invention to provide an inkjet recording element which can be printed with ink jet inks and fused to provide high density images. It is another object of the invention to provide a porous ink-transporting layer that has good mechanical integrity and is abrasion resistant. It is another object of the invention to provide a protective uppermost ink-transporting layer that is thermally fusible and thereby can be rendered water resistant. It is another object to provide an inkjet recording element that has a fusible dye-trapping layer which captures and retains inkjet dyes, and which can be subsequently fused to remove light scatter and provide optimal image density.

SUMMARY OF THE INVENTION

These and other objects are achieved in accordance with the invention which comprises an ink jet recording element comprising a support having thereon in order:

a) at least one porous, ink carrier liquid receptive layer;

b) a fusible, porous dye-trapping layer comprising fusible polymeric particles, a binder, and a dye mordant; and c) a fusible, porous ink-transporting layer comprising fusible, polymeric particles and a film-forming, hydrophobic binder.

By use of the invention, a porous ink jet recording element is obtained that has good abrasion resistance, and which when printed with an ink jet ink, and subsequently fused, has good water-resistance and high print density.

DETAILED DESCRIPTION OF THE INVENTION

The uppermost porous ink-transporting layer allows for passage of the ink to the underlying layers, but is non-retentive of the dye colorant.

The fusible, polymeric particles employed in the uppermost ink-transporting layer of the invention may have any particle size provided they will form a porous layer. In a preferred embodiment of the invention, the particle size of the fusible, polymeric particle may range from about 0.5 to about 10 $\mu$m.

Upon fusing of the polymeric particles, the air particle interfaces present in the original porous structure of the layer are eliminated and a non-scattering, substantially continuous, protective overcoat forms over the image. The fusible, polymeric particles may be formed from a condensation polymer, a styrenic polymer, a vinyl polymer, an ethylene-vinyl chloride copolymer, a polyacrylate, poly (vinyl acetate), poly(vinylidene chloride), or a vinyl acetate-vinyl chloride copolymer. In a preferred embodiment of the invention, the fusible, polymeric particles are comprised of a cellulose acetate ester, a polyester or a polyurethane. Most preferred is a cellulose acetate butyrate.

The uppermost porous ink-transporting layer of fusible polymeric particles will additionally contain a film-forming hydrophobic binder. The film-forming, hydrophobic binder useful in the invention can be any film-forming hydrophobic polymer capable of being dispersed in water. In a preferred embodiment of the invention, the hydrophobic binder is an aqueous dispersion of an acrylic polymer or a polyurethane.

In order to be non-retentive of dyes, the polymers comprising the fusible particles and the hydrophobic binder should either be non-ionic or of the same charge type as the dye. Since ink jet dyes are anionic in a preferred embodiment, both the fusible polymeric particles and the hydrophobic film-forming binder are either nonionic or anionic. Accordingly, in a most preferred embodiment, the polymers comprising the fusible particles and the film-forming hydrophobic binder shall either have no ionic functionality or anionic functionality.

The particle-to-binder ratio of the particles and binder employed in the ink-transporting layer can range between about 98:2 and 60:40 and preferably between about 95:5 and about 80:20. In general, a layer having particle-to-binder ratios above the range stated will usually not have sufficient cohesive strength; and a layer having particle-to-binder ratios below the range stated will usually not be sufficiently porous to provide good image quality.

The ink-transporting layer is usually present in an amount from about 1 $g/m^2$ to about 50 $g/m^2$. In a preferred embodiment, the ink-transporting layer is present in an amount from about 1 $g/m^2$ to about 10 $g/m^2$.

The porous fusible dye-trapping layer receives the ink from the uppermost ink-transporting layer, retains substantially all the dye, and allows for the passage of the ink carrier liquid to the underlying porous carrier liquid receptive layer. Upon fusing, via the application of heat and/or pressure, the air particle interfaces present in the original porous structure of the layer are eliminated, and a non-scattering substantially continuous layer forms which contains the dye image. It is an important feature of the invention that both the uppermost ink-transporting and the immediately underlying dye-trapping layer be transformable into non-scattering layers as this significantly raises image density.

The fusible, polymeric particles employed in the dye-trapping layer of the invention ranges from about 0.1 $\mu$m to 10 $\mu$m. In a preferred embodiment of the invention, the particle size of the fusible, polymeric particle in the dye-trapping layer is smaller than the particles employed in the porous, ink-transporting layer, and larger than the particles employed in the porous carrier liquid receptive layer.

The particles employed in the dye-trapping layer may be formed from any polymer which is fusible, i.e., capable of being converted from discrete particles into a substantially continuous layer through the application of heat and/or pressure. In a preferred embodiment of the invention, the fusible, polymeric particles comprise a condensation polymer, a styrenic polymer, a vinyl polymer, an ethylene-vinyl chloride copolymer, a polyacrylate, poly(vinyl acetate), poly(vinylidene chloride), or a vinyl acetate-vinyl chloride copolymer. In still another preferred embodiment, the condensation polymer may be a polyester or polyurethane. In a most preferred embodiment of the invention, the fusible, polymeric particles are comprised of a copolymer of 86 parts by weight of ethyl methacrylate and 14 parts by weight of methyl methacrylate, Tg=85C.

The binder employed in the dye-trapping layer can be any film-forming polymer that serves to bind together the fusible polymeric particles. In a preferred embodiment of the invention, the binder is a hydrophobic film forming binder derived from an aqueous dispersion of an acrylic polymer or a polyurethane.

The dye mordant employed in the dye-trapping layer can be any material which is substantive to the ink jet dyes. The dye mordant removes dyes from the ink received from the porous ink-transporting layer and fixes the dye within the dye-trapping layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quartenary ammonium compounds, or basic polymers, such as poly (dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly (2-N,N,N-trimethylammonium)ethyl methacrylate methosulfate; poly (3-N,N,N-trimethyl-ammonium)propyl methacrylate chloride; a copolymer of vinylpyrrolidinone and vinyl(N-methylimidazolium chloride; and hydroxyethylcellulose derivatized with 3-N,N,N-trimethylammonium)propyl chloride. In a preferred embodiment, the cationic mordant is a quaternary ammonium compound.

In order to be compatible with the mordant, both the binder and the polymer comprising the fusible particles should be either uncharged or the same charge as the mordant. Colloidal instability and unwanted aggregation would result if the polymer particles or the binder had a charge opposite from that of the mordant.

The fusible particles in the dye-trapping layer may range from about 95 to about 60 parts by weight, the binder may range from about 40 to about 5 parts by weight, and the dye mordant may range from about 2 parts to about 40 parts by weight. Most preferred is 80 parts by weight fusible particles, 10 parts by weight binder, and 10 parts by weight dye mordant.

The dye-trapping layer is present in an amount from about 1 $g/m^2$ to about 50 $g/m^2$. In a preferred embodiment, the dye-trapping layer is present in an amount from about 1 $g/m^2$ to about 10 $g/m^2$.

The porous ink carrier liquid receptive layer receives the ink carrier liquid after the ink has passed through the porous ink-transporting layer, and through the porous dye-trapping layer where substantially all the dye has been removed. The ink carrier liquid receptive layer can be any porous structure, but it is preferred that the mean pore radius is smaller than the mean pore radius of the dye-trapping layer, which in turn is smaller than the mean pore radius of uppermost ink-transporting layer. Thus, if the ink carrier liquid receptive layer is composed of particles and binder, the particles will be significantly smaller than the fusible, polymeric particles in the dye-trapping layer, which will be significantly smaller than the particles in the upper ink-transporting layer thereby assuring a correct pore-size hierarchy. The correct pore size hierarchy facilitates fluid transport from the uppermost porous ink transporting layer, through the porous dye-trapping layer, and into the porous carrier liquid receptive layer.

In a preferred embodiment, the ink carrier liquid receptive layer is present in an amount from about 1 $g/m^2$ to about 50 $g/m^2$, preferably from about 10 $g/m^2$ to about 45 $g/m^2$.

In general, the base ink porous carrier liquid receptive layer will have a thickness of about 1 $\mu$m to about 50 $\mu$m, the porous dye-trapping layer residing thereon will have a thickness of about 2 $\mu$m to about 50 $\mu$m, and the porous ink-transporting layer residing thereon will usually have a thickness of about 2 $\mu$m to about 50 $\mu$m.

In a preferred embodiment of the invention, the ink carrier liquid receptive layer is a continuous, co-extensive porous layer which contains organic or inorganic particles. Examples of organic particles which may be used include core/shell particles such as those disclosed in U.S. Ser. No. 09/608,969 of Kapusniak et al., filed Jun. 30, 2000, and homogeneous particles such as those disclosed in U.S. Ser. No. 09/608,466 of Kapusniak et al., filed Jun. 30, 2000, the disclosures of which are hereby incorporated by reference. Examples of organic particles which may be used in this layer include acrylic resins, styrenic resins, cellulose derivatives, polyvinyl resins, ethylene-allyl copolymers and polycondensation polymers such as polyesters.

Examples of inorganic particles which may be used in the ink carrier liquid receptive layer of the invention include silica, alumina, titanium dioxide, clay, calcium carbonate, barium sulfate, or zinc oxide.

In a preferred embodiment of the invention, the porous ink carrier liquid receptive layer comprises from about 20% by weight to about 100% by weight of particles and from about 0% to about 80% by weight of a polymeric binder, preferably from about 80% by weight to about 95% by weight of particles and from about 20% by weight to about 5% by weight of a polymeric binder. In a preferred embodiment, the polymeric binder may be a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly (vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

Suitable porous materials for an ink carrier liquid receptive layer include, for example, silica or alumina in a polymeric binder. In a preferred embodiment, the ink carrier liquid receptive layer is porous fumed alumina in a crosslinked poly(vinyl alcohol) binder.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melaamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

The porous ink carrier liquid receptive layer can also comprise an open-pore polyolefin, an open-pore polyester or an open pore membrane. An open pore membrane can be formed in accordance with the known technique of phase inversion. Examples of a porous ink-receiving layer comprising an open-pore membrane are disclosed in U.S. Ser. No. 09/626,752 and U.S. Ser. No. 09/626,883, both of Landry-Coltrain et al., filed Jul. 27, 2000.

The support used in the ink jet recording element of the invention may be opaque, translucent, or transparent. There may be used, for example, plain papers, resin-coated papers, various plastics including a polyester resin such as poly (ethylene terephthalate), poly(ethylene naphthalate) and poly(ester diacetate), a polycarbonate resin, a fluorine resin such as poly(tetra-fluoro ethylene), metal foil, various glass materials, and the like. In a preferred embodiment, the support is a resin-coated paper. The thickness of the support employed in the invention can be from about 12 to about 500 $\mu$m, preferably from about 75 to about 300 $\mu$m.

If desired, in order to improve the adhesion of the base layer to the support, the surface of the support may be corona-discharge-treated prior to applying the base layer or solvent-absorbing layer to the support.

Since the image recording element may come in contact with other image recording articles or the drive or transport mechanisms of image recording devices, additives such as surfactants, lubricants, matte particles and the like may be added to the element to the extent that they do not degrade the properties of interest.

The layers described above, including the ink carrier liquid receptive layer, the dye-trapping layer, and the ink-transporting layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of all three layers, which is preferred from a manufacturing economic perspective.

After printing on the element of the invention, the fusible, porous ink-transporting layer is heat and/or pressure fused to form a substantially continuous overcoat layer on the surface. In addition, the dye-trapping layer is also fused at the same time. Upon fusing, these layers are rendered non-light scattering. Fusing may be accomplished in any manner which is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference.

In a preferred embodiment, fusing is accomplished by contacting the surface of the element with a heat fusing member, such as a fusing roller or fusing belt. Thus, for example, fusing can be accomplished by passing the element through a pair of heated rollers, heated to a temperature of about 60° C. to about 160° C., using a pressure of 5 to about 15 MPa at a transport rate of about 0.005 m/sec to about 0.5 m/sec.

Ink jet inks used to image the recording elements of the present invention are well known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Preparation of Porous Ink Carrier Liquid Receptive Layer on Support

A polyethylene resin-coated paper support was corona discharge treated. The support was then hopper coated with a 2% solids by weight aqueous solution of 0.11 g/m$^2$ borax and 0.07 g/m$^2$ GH-17® (Nippon Gohsei) poly(vinyl alcohol) to give a subbing layer.

A coating solution at 32% solids was prepared by combining 1290 g of a 34.5% dispersion of cationic colloidal alumina, Catapal 200® (Condea Vista Co.) having a particle size of 0.12 $\mu$m as determined using a Horiba LA-920 Particle Size Analyzer, 260 g of a 17.3% solution of GH-17® poly(vinyl alcohol), 10.0 g of dihydroxydioxane crosslinking agent, and 15.6 g of a 10% solution of Olin 10G surfactant.

The subbed support was then hopper coated with the above coating solution at a solids laydown of 45.4 g/m$^2$ and force air dried at 60° C. to provide a layer comprising 89% cationic colloidal alumina, 9% poly(vinyl alcohol), and 2% dihydroxydioxane crosslinking agent.

Synthesis of Fusible Polymeric Particles for Dye-trapping Layer

A 12-liter, Morton reaction flask was charged with 4 Kg of demineralized water. The flask contents were heated to 80° C. while stirring at 150 rpm under a nitrogen atmosphere. The initiator solution addition flask was made up with 1974 g of demineralized water and 26.4 g of 2,2'-azobis (2-methylpropionamidine)dihydrochloride. A monomer phase addition flask was prepared by adding 2182 g of ethyl methacrylate, and 364 g of methyl methacrylate. Then, charges to the reaction flask from each addition flask were started at 5 g per minute. The addition flasks were recharged as needed. Samples were taken at various times and the monomer phase feed was stopped when the desired latex particle size was reached. The charges of the redox initiator solutions were extended for 30 minutes beyond the end of the monomer phase addition to react with residual monomers. The reaction flask contents were stirred at 80° C. for one hour followed by cooling to 20° C., and filtration through 200 $\mu$m polycloth. The latex was concentrated by ultrafiltration to obtain a 25.6% solids dispersion of cationically charged surfactant-free 0.40 $\mu$m poly (ethylmethacrylate-co-methylmethacrylate) particles, as determined using a Horiba LA-920 Particle Size Analyzer, with a Tg=85C.

Preparation of Porous Fusible Dye-trapping Layer

A coating solution at 20% solids was prepared by combining 312 g of the 25.6% solids dispersion of poly (ethylmethacrylate-co-methylmethacrylate) fusible polymeric particles prepared above, with 28.6 g of a film forming hydrophobic binder Witcobond® W320 (Uniroyal Chemical Co.) a 35% by weight aqueous dispersion of 1.9 $\mu$m polyurethane particles Tg=−12° C., and 66.7 g of a 15% solids 100 nm colloidal latex dispersion of divinylbenzene-co-N-vinylbenzyl-N,N,N-trimethylammonium chloride, a dye mordant, 8.0 g of a 10% solution of Olin 10G surfactant and the requisite amount of water. The coating solution was hopper coated at a solids laydown of 8.6 g/m$^2$ onto the porous ink carrier liquid receptive layer described above to give a porous, fusible dye-trapping layer having 80 parts by weight of fusible polymeric particles, 10 parts by weight of film forming hydrophobic binder and 10 parts by weight of dye mordant. The mordant laydown was 0.86 g/m$^2$.

Preparation of Control Dye-trapping Layer (No Fusible Particles)

A coating solution at 20% solids was prepared by combining 57.6 g of a 34.5% dispersion of cationic colloidal alumina Catapal 200® non-fusible particles, 13 g of a 17.3% solution of poly(vinyl alcohol) GH-17, 0.70 g of dihydroxydioxane crosslinking agent, 16.8 g of a 15% solids 100 nm colloidal latex dispersion of divinylbenzene-co-N-vinylbenzyl-N,N,N-trimethylammonium chloride dye mordant, 0.80 g of Olin 10G surfactant and the requisite quantity of deionized water. The coating solution was hopper coated at a solids laydown of 8.6 g/m$^2$ onto the porous ink carrier liquid receptive layer described above to give a porous, non-fusible dye-trapping layer having 78 parts by weight of non-fusible refractory alumina particles, 12 parts by weight of crosslinked poly(vinyl alcohol) binder, and 10 parts by weight of dye mordant. The mordant laydown 0.86 g/m$^2$ was the same as for the fusible dye-trapping layer.

Preparation of Control Dye-trapping Layer (No Mordant)

A coating solution at 20% solids was prepared by combining 88 g of the 25.6% solids dispersion of poly (ethylmethacrylate-co-methylmethacrylate) fusible polymeric particles prepared above, with 7.1 g of a film forming hydrophobic binder Witcobond® W320, a 35% by weight aqueous dispersion of 1.9 $\mu$m polyurethane particles Tg=−12° C., 2.0 g of Olin 10G surfactant, and the requisite quantity of deionized water. The coating solution was hopper coated at a solids laydown of 8.6 g/m$^2$ onto the porous ink carrier liquid receptive layer described above to give a porous, fusible layer having 90 parts by weight of fusible polymeric particles, and 10 parts by weight of film forming hydrophobic binder.

Synthesis of Fusible Polymeric Particles For Ink-transporting Layer

An ethylacetate solution was prepared by dissolving 92.25 g of cellulose acetate butyrate (Eastman Chemical Company CAB-551-0.2) in 153.75 grams of ethyl acetate at 65° C. with stirring. An aqueous solution was prepared combining 24 g of a 10% solution of Calfax DB-45 (Pilot Chemical Company) and 330 g of water and heated to 65° C. The aqueous phase composition was added to the organic phase composition while mixing vigorously with a propeller mixer and then converted to a crude emulsion by homogenizing for 2 minutes with a Silverson rotor-stator mixer at 5000 rpm. The crude emulsion was passed through a Microfluidics Model 110F Microfluidizer one time at 31 MPa and collected in a round bottom flask. Rotary evaporation of the homogenized mixture at 65° C. under vacuum to remove the ethyl acetate gave a dispersion of 1.5 μm cellulose acetate butyrate particles, as determined using a Horiba LA-920 Particle Size Analyzer, dispersed in water.

Preparation of Porous Fusible Ink-transporting Layer

A coating solution at 20% solids was prepared by adding to 90 parts of the cellulose acetate butyrate particles prepared above, and 10 parts binder Witcobond® W320 an aqueous dispersion of 1.9 μm polyurethane particles Tg=−12° C. The coating solution was hopper coated at 8.6 g/m$^2$ onto the above prepared porous fusible dye trapping layer to give Element 1. The same coating solution was hopper coated at 8.6 g/m$^2$ onto both, the above prepared non-fusible dye-trapping layer to give Control Element C-1, and onto the above prepared non-mordant containing dye-trapping layer to give Control Element C-2.

Preparation of Control Element C-3 (No Dye-trapping Layer)

The same coating solution comprising cellulose acetate butyrate particles and Witcobond® W320 used to prepare the above porous fusible ink-transporting layers in Element 1, Control Element C-1 and Control Element C-2, was hopper coated at 8.6 g/m$^2$ directly onto the porous ink carrier liquid receptive layer to afford Control Element C-3.

Printing

A density test target was printed on Element 1 and the Control Elements with a Hewlett-Packard Photosmart® printer using best mode, glossy photographic paper setting and print cartridges C3844A and C3845A.

The density target had solid rectangles with each of the primary and secondary subtractive colors, i.e., C,M,Y,R,G, B, and K.

Fusing

The printed elements were fused in a heated nip at 150° C. and 4.2 kg/cm$^2$ against a sol-gel coated polyimide belt at 63.5 cm/min.

Testing

Densities of the fused prints were measured with a Spectrolina Densitometer. Densities of the primary subtractive colors, Cyan, Magenta, and Yellow, are reported directly. Densities of the secondary subtractive colors are reported as follows: Red density as the average of the Magenta and Yellow densities; Green as the average of the Cyan and Yellow densities; and Blue as the average of the Magenta and Cyan densities. Optical densities greater than 2.0 are considered acceptable. The following results were obtained:

TABLE 1

| Element | Cyan | Magenta | Yellow | Black | Red | Green | Blue |
|---|---|---|---|---|---|---|---|
| C-1 | 2.15 | 1.87 | 1.70 | 2.02 | 1.74 | 1.90 | 2.06 |
| C-2 | 1.88 | 1.37 | 1.40 | 1.56 | 1.19 | 1.39 | 1.56 |
| C-3 | 1.76 | 1.28 | 1.27 | 1.46 | 1.15 | 1.30 | 1.46 |
| 1 | 2.08 | 2.09 | 2.02 | 2.29 | 2.01 | 2.14 | 2.33 |

The above results show that Element 1 of the invention had higher densities for all but one color than the control elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon in order:

a) at least one porous, ink carrier liquid receptive layer;

b) a fusible, porous dye-trapping layer comprising fusible polymeric particles, a binder, and a dye mordant; and c) a fusible, porous ink-transporting layer comprising fusible, polymeric particles and a film-forming, hydrophobic binder.

2. The element of claim 1 wherein said porous, ink carrier liquid receptive layer comprises from about 50% by weight to about 95% by weight of particles and from about 50% by weight to about 5% by weight of a polymeric binder.

3. The element of claim 2 wherein said particles is said ink carrier liquid receptive layer comprise silica, alumina, titanium dioxide, clay, calcium carbonate, barium sulfate, zinc oxide or mixtures thereof.

4. The element of claim 2 wherein said polymeric binder is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin.

5. The element of claim 2 wherein the particles of said dye-trapping layer are larger that the particles of said ink carrier liquid receptive layer and smaller than the particles of said ink-transporting layer.

6. The element of claim 1 wherein said fusible polymeric particles in said fusible, porous dye-trapping layer comprise a condensation polymer, a styrenic polymer, a vinyl polymer, an ethylene-vinyl chloride copolymer, a polyacrylate, poly(vinyl acetate), poly(vinylidene chloride), a vinyl acetate-vinyl chloride copolymer, a polyester, or a polyurethane.

7. The element of claim 1 wherein said fusible polymeric particles in said fusible, porous dye-trapping layer comprise a copolymer of ethyl methacrylate and methyl methacrylate.

8. The element of claim 1 wherein said binder in said fusible, porous dye-trapping layer comprises an aqueous dispersion of an acrylic polymer or a polyurethane.

9. The element of claim 1 wherein said fusible polymeric particles in said fusible, porous dye-trapping layer are cationic.

10. The element of claim 1 wherein said mordant in said fusible, porous dye-trapping layer comprises a cationic latex.

11. The element of claim 1 wherein said fusible, polymeric particles in said fusible, porous ink-transporting layer range in size from about 0.5 to about 10 μm.

12. The element of claim 1 wherein the particle-to-binder ratio of the particles and binder in said ink-transporting layer is between about 95:5 and 60:40.

13. The element of claim 1 wherein said fusible polymeric particles in said ink-transporting layer comprise a condensation polymer, a styrenic polymer, a vinyl polymer, an ethylene-vinyl chloride copolymer, a polyacrylate, poly (vinyl acetate), poly(vinylidene chloride), a vinyl acetate-vinyl chloride copolymer, a polyester, or a polyurethane.

14. The element of claim 1 wherein said fusible polymeric particles in said ink-transporting layer comprise a cellulose acetate ester.

15. The element of claim 1 wherein said fusible polymeric particles in said ink-transporting layer comprise a cellulose acetate butyrate.

16. The element of claim 1 wherein said fusible polymeric particles in said ink-transporting layer are anionic or non-ionic.

17. The element of claim 1 wherein said hydrophobic film-forming binder in said ink-transporting layer comprises an aqueous dispersion of an acrylic polymer or a polyurethane.

18. The element of claim 1 wherein said hydrophobic film-forming binder in said ink-transporting layer is anionic or non-ionic.

* * * * *